US007591348B2

(12) United States Patent
Takeuchi

(10) Patent No.: US 7,591,348 B2
(45) Date of Patent: Sep. 22, 2009

(54) DESTINATION FLOOR REGISTER FOR ELEVATOR

(75) Inventor: Nobukazu Takeuchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 565 days.

(21) Appl. No.: 10/577,156

(22) PCT Filed: Aug. 30, 2004

(86) PCT No.: PCT/JP2004/012503

§ 371 (c)(1),
(2), (4) Date: Apr. 26, 2006

(87) PCT Pub. No.: WO2006/025096

PCT Pub. Date: Mar. 9, 2006

(65) Prior Publication Data

US 2007/0158140 A1 Jul. 12, 2007

(51) Int. Cl.
*B66B 1/34* (2006.01)

(52) U.S. Cl. ..... 187/391; 187/396

(58) Field of Classification Search ..... 187/391–396
See application file for complete search history.

(56) References Cited

U.S. PATENT DOCUMENTS 4,655,325 A * 4/1987 Schroder et al. ..... 187/387
5,454,448 A * 10/1995 Bittar et al. ..... 187/395
5,679,934 A * 10/1997 Juntunen et al. ..... 187/395
5,969,306 A * 10/1999 Velauthapillai et al. ..... 187/395
6,161,654 A * 12/2000 Sirigu et al. ..... 187/391
6,550,587 B1 * 4/2003 Yuasa et al. ..... 187/394
6,801,792 B1 * 10/2004 Schuster et al. ..... 455/566
7,398,865 B2 * 7/2008 Felder et al. ..... 187/395

FOREIGN PATENT DOCUMENTS

| | | | |
|---|---|---|---|
| CN | 1368935 | A | 9/2002 |
| EP | 1 291 311 | A1 | 3/2003 |
| JP | 60-162555 | | 10/1985 |
| JP | 01242378 | A * | 9/1989 |
| JP | 3-26678 | | 2/1991 |
| JP | 1770/1993 | | 1/1993 |
| JP | 5-24669 | | 3/1993 |
| JP | 6-191753 | | 7/1994 |
| JP | 6-340385 | | 12/1994 |
| JP | 8-34573 | | 2/1996 |
| JP | 11-139704 | | 5/1999 |
| JP | 2002-348063 | | 12/2002 |

* cited by examiner

*Primary Examiner*—Jonathan Salata
(74) *Attorney, Agent, or Firm*—Oblon, Spivak, McClelland, Maier & Neustadt, P.C.

(57) ABSTRACT

A destination floor registering apparatus that can at any time and appropriately afford information on each floor to elevator users. For this purpose, a floor information display is provided for each destination button so that the contents of displays of the floor information display become visible from an operation surface of each of the destination buttons which a user operates in registering a desired destination floor, and the contents of displays of the floor information display are changed at any time according to operation conditions. Furthermore, information is displayed by a continuous change in colors, characters, or graphics to positively communicate the contents of displays of the floor information display to the user.

15 Claims, 5 Drawing Sheets

DESTINATION FLOOR REGISTER FOR ELEVATOR

TECHNICAL FIELD

The present invention relates to a destination floor registering apparatus which is installed in a hall or a car of an elevator and by use of which a user of the elevator in the hall or the car registers a desired destination floor.

BACKGROUND ART

Some conventional destination floor registering apparatus which are installed in a hall or a car of an elevator and by use of which a user of the elevator registers a desired destination floor are provided with a touch panel which the user can operate by a finger touch. At the same time, these destination floor registering apparatus are provided, on a display of the touch panel, with destination buttons for registering destination floors and a dedicated information display so that carefully thought out displays are made possible by changing the contents of the dedicated information display at any time according to the destination floors registered by use of the destination buttons (refer to Patent Document 1, for example).

Patent Document 1: Japanese Patent Laid-Open No. 6-191753

DISCLOSURE OF THE INVENTION

Problems to be Solved by the Invention

In the destination floor registering apparatus of an elevator described in Patent Document 1, general information, such as time and weather forecasts, is displayed on a dedicated information display provided on a display of a touch panel and when a user registers a destination floor, the display is appropriately changed according to the registered destination floor. However, because this destination floor registering apparatus is provided with only one information display for multiple destination buttons, detailed floor information etc. such as tenants on each floor could not be displayed in detail unless that was done after a destination floor had been registered by an user. Also, for the destination buttons on the display of the touch panel, the fact that a destination floor has been registered is displayed by changing a display color. However, in a case where a user who operates the destination floor registering apparatus has a color vision disorder, it was difficult for this user to make a judgment as to whether a destination floor had been effectively registered.

The present invention has been made to solve this problem and the object of the invention is to obtain a destination floor registering apparatus of an elevator which can offer better service by appropriately and at any time providing information on each floor.

Furthermore, the object is to provide a destination floor registering apparatus of an elevator capable of positively communicating information displays.

Means For Solving the Problems

The destination floor registering apparatus of an elevator comprises multiple destination buttons which a user of the elevator operates in registering a destination floor, and floor information display means which is provided for each of the destination buttons so that the contents of displays become visible from an operation surface of each of the destination buttons and which allows the contents of displays to be changed.

Effect of the Invention

Because the present invention comprises multiple destination buttons which a user of the elevator operates in registering a destination floor, and floor information display means which is provided for each of the destination buttons so that the contents of displays become visible from an operation surface of each of the destination buttons and which allows the contents of displays to be changed, the present invention can offer better service by appropriately and at any time providing information on each floor.

DESCRIPTION OF SYMBOLS

Figure 1:
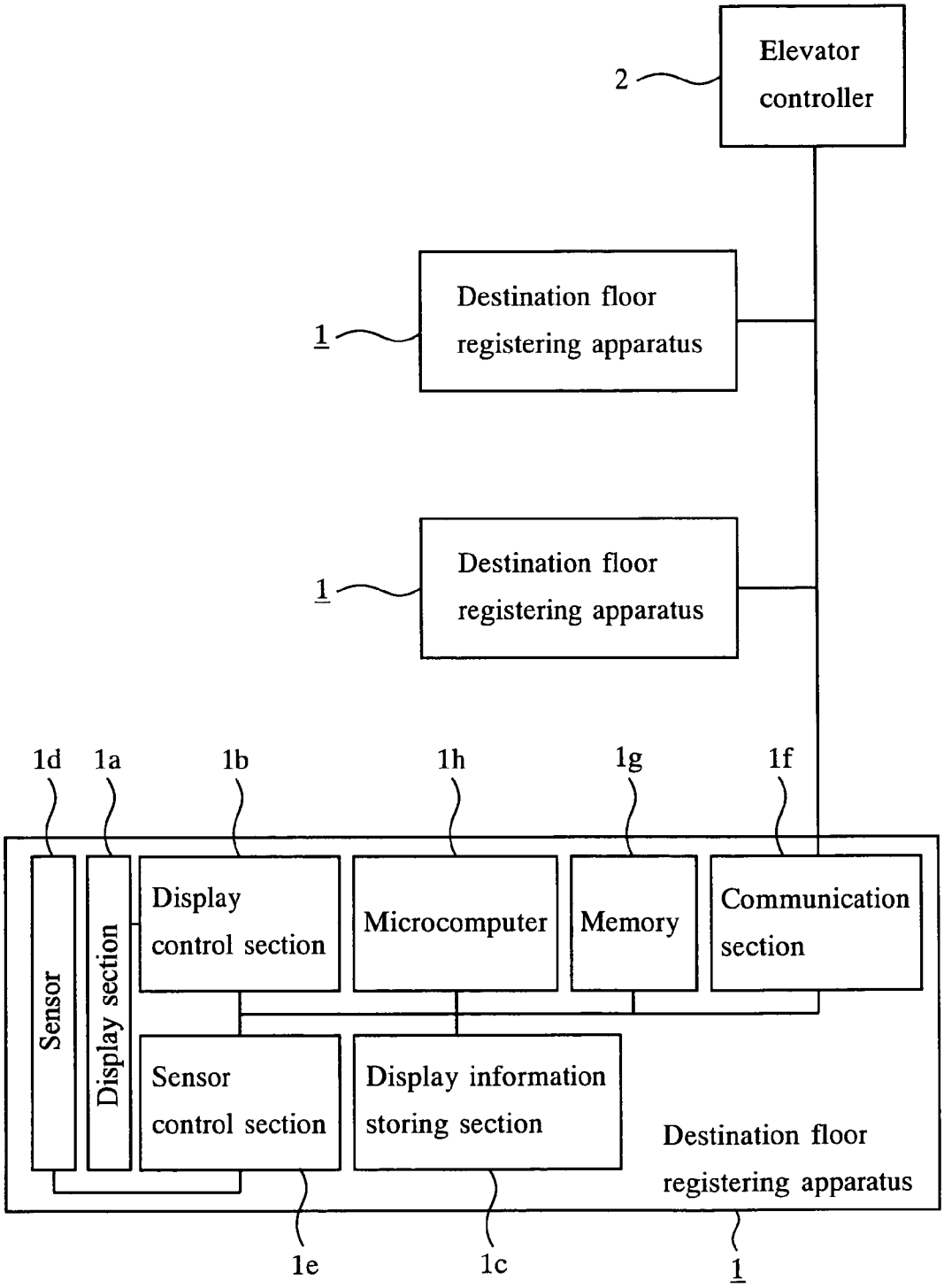
FIG. 1 is a block diagram which shows the general construction of the destination floor registering apparatus of an elevator in Embodiment 1 of the present invention.

1 Destination floor registering apparatus
1*a* Display section
1*b* Display control section
1*c* Display information storing section
1*d* Sensor
1*e* Sensor control section
1*f* Communication section
1*g* Memory
1*h* Microcomputer
1*k*, 1*p*, 1*r* Destination button
1*m* General information display means
1*n* Floor information display means
2 Elevator controller

BEST MODE FOR CARRYING OUT THE INVENTION

The present invention will be described in further detail in accordance with the accompanying drawings. Incidentally, in the drawings, the same or corresponding parts are identified by the same reference numerals and overlapping descriptions of these parts are appropriately simplified or omitted.

Embodiment 1

FIG. 1 is a block diagram which shows the general construction of a destination floor registering apparatus of an elevator in Embodiment 1 of the present invention. In the figure, a destination floor registering apparatus 1 of an elevator by use of which a user of the elevator registers his or her desired destination floor is installed in halls provided on each floor of a building and in a car ascending and descending through a shaft. Each of the destination floor registering apparatus 1 is connected to an elevator controller 2 which controls the whole elevator apparatus via communication channels, and this elevator controller 2 controls the ascent and descent of a car on the basis of destination floor information inputted from each of the destination floor registering apparatus 1 and sends registered destination floor information, as required, to each of the destination floor registering apparatus 1. Incidentally, this destination floor registering apparatus 1 is installed in quantities of at least one set per hall and car. However, in a case where multiple hall entrances are provided in one hall, in a case where a destination floor registering apparatus 1 used exclusively for a wheelchair is installed in a car, and in other cases, two or more destination floor registering apparatus 1 can be installed in one hall or car. This destination floor registering apparatus 1 installed in a hall or a car is provided with a display section 1*a* having multiple destination buttons which a user of an elevator operates in registering a desired destination floor and floor information display means which is disposed for each of the destination buttons so that the contents of displays become visible from an operation surface of each of the destination buttons which the user touches with his or her finger in registering the destination floor and which displays colors, characters, graphics, etc. which show destination floors and floor information etc. of destination floors in a changeable manner, a display control section 1*b* which controls the contents of displays such as colors, characters and graphics displayed in this floor information display means of this display section 1*a* and shapes etc. of the destination buttons of the display section 1*a,* a display information storing section 1*c* which stores display information such as colors, characters and graphics, displayed in the floor information display means of the display section 1*a,* a sensor 1*d* which detects that the user of the elevator has operated a destination button of the display section 1*a* in order to register a desired destination floor, a sensor control section 1*e* which controls this sensor 1*d,* a communication section 1*f* which controls the input and output of signals with an elevator controller 2 connected by a communication channel, a memory 1*g* which is provided with a scratchpad memory and a program storing memory which stores a prescribed program, and a microcomputer 1*h* which executes a program stored in the program storing memory while using the scratchpad memory.

Incidentally, it is required from the above-descried floor information display means of the display section 1*a* only that it have the function of enabling a user of an elevator to see the contents of the display from operation surfaces of destination buttons, that is, it be able to display information composed by characters, graphics, etc. on the operation surfaces of destination buttons, and any display method, such as the liquid crystal method, the plasma method, the LED method and the cathode-ray tube method, may be adopted. The above-descried sensor 1*d* may be of any type so long as it can accurately detect whether a user of an elevator has operated a destination button of the display section 1*a,* and for example, a touch panel type which is integrally constructed with the floor information display means of the display section 1*a,* a mechanical type in which a moving contact comes into contact when a destination button is depressed with a prescribed force by a prescribed distance and the like may be adopted. Furthermore, the scratchpad memory and program storing memory within the above-described memory 1*g* and the above-described display information storing section 1*c* may be composed of any storage device and memory element, such as a hard disk drive, a nonvolatile memory, and a memory which requires RAM actions, and part of these memories may be formed as the same storage device and memory element. Also, for the memory 1*g,* the display information storing section 1*c,* the display control section 1*b* and the communication section 1*f,* even when a part or the whole of these components is built in the microcomputer 1*h,* their construction does not pose a problem if these components have their functions.

Figure 2:
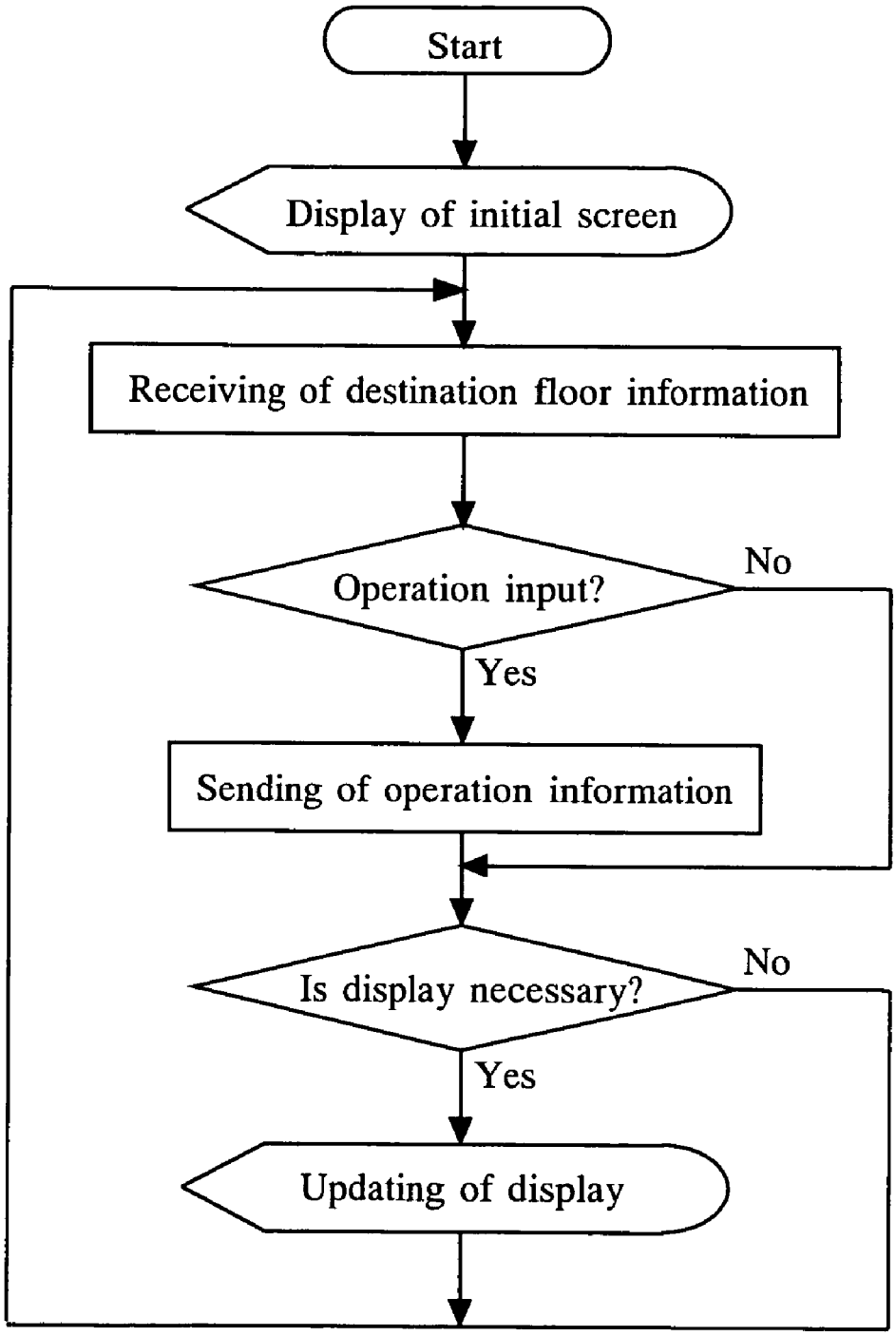
FIG. 2 is a flowchart which shows the operation of the destination floor registering apparatus of an elevator in Embodiment 1 of the present invention.

Next, the operation of the destination floor registering apparatus 1 of an elevator related to the present invention will be described on the basis of the flowchart shown in FIG. 2. When the operation of the destination floor registering apparatus 1 is started, a necessary initial screen, such as information on tenants on each floor etc. and a background screen, is displayed in the floor information display means of the display section 1*a.* Incidentally, the screen information of this initial screen is information stored beforehand in the display information storing section 1*c.* When the operation start information of the destination floor registering apparatus 1 is inputted to the microcomputer 1*h,* the microcomputer 1*h* takes out the screen information of the initial screen from the display information storing section 1*c* on the basis of this operation start information which has been inputted and displays this screen information in each of the floor information display means of the display section 1*a* via the display control section 1*b.* At this time, when a destination floor is registered by a user in other destination floor registering apparatus 1 and this destination information is inputted to the elevator controller 2, the elevator controller 2 outputs this destination floor information to the communication section 1*f* of each of the destination floor registering apparatus 1. When destination floor information from other destination floor registering apparatus 1 is inputted to the communication section 1*f,* the microcomputer 1*h* of the destination floor registering apparatus 1 takes out display information corresponding to the destination floor information inputted to the communication section 1*f* from the display information storing section 1*c* and outputs this display information to the display control section lb. On the other hand, when a user of an elevator has registered a destination floor by use of this destination floor registering apparatus 1, that is, when the sensor 1*d* has detected that a destination button of the display section 1*a* had been operated, the sensor control section 1*e* outputs operation information, such as operation coordinates etc. detected by the sensor 1*d,* to the microcomputer 1*h.* Also, when a user of an elevator has finished the registration operation of a destination floor by use of this destination floor registering apparatus 1, that is, when the sensor 1*d* has not detected any more the operation of a destination button of the display section 1*a,* the sensor control section 1*e* outputs operation finish information that the operation has been finished, along with the above-described operation information, to the microcomputer 1*h.* When operation information is inputted from the sensor control section 1*e* to the microcomputer 1*h,* the microcomputer 1*h* judges the contents of the destination button registered by the user on the basis of the operation coordinates. Furthermore, the microcomputer 1*h* compares, on the basis of the operation coordinates, the contents of displays presently displayed in the floor information display means of the display section 1*a* with the contents of the destination button which have been registered and makes a judgment as to whether the contents of displays of the floor information display means of the display section 1*a* should be updated. At this time, when it is judged that the updating of the contents of displays of the floor information display means be necessary, the microcomputer 1*h* takes out corresponding display information from the display information storing section 1*c* on the basis of the inputted operation information and output this display information to the display control section 1*b*. Incidentally, in parallel with the above-described operation, the microcomputer 1*h* outputs the inputted destination floor information to the elevator controller 2 via the communication section 1*f*. When display information is inputted from the microcomputer 1*h* to the display control section 1*b*, on the basis of this display information the display control section 1*b* displays the contents in the floor information display means of the display section 1*a*. Incidentally, FIG. 2 shows a case where destination floor information is inputted to the communication section 1*f* from the elevator controller 2 and a case where the sensor 1*d* has detected the input operation of a destination button as a series of operations. However, no special problem arises even when these operations are executed in a parallel asynchronous manner.

Figure 3:
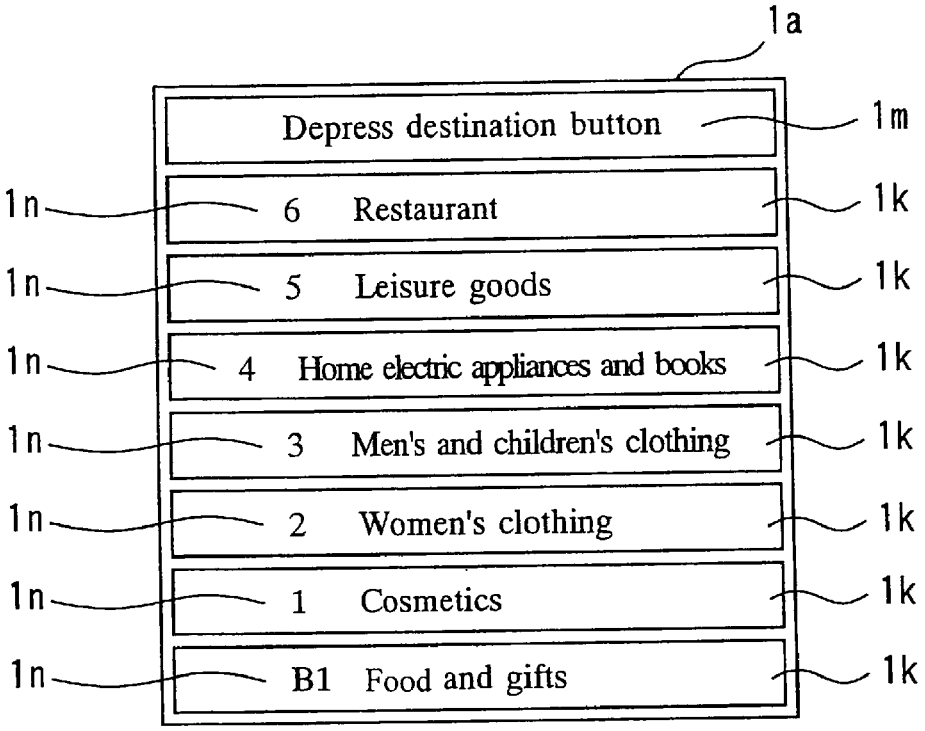
FIG. 3 is a partial diagram of the destination floor registering apparatus of an elevator in Embodiment 1 of the present invention.

Next, the display section 1*a* of the destination floor registering apparatus 1 will be described. FIG. 3 is a partial detail diagram of the destination floor registering apparatus 1 of an elevator in Embodiment 1 of the present invention, which shows the construction of the display section 1*a*. In the figure, the display section 1*a* disposed opposite to users of an elevator is provided with multiple destination buttons 1*k* which a user of the elevator operates in registering a desired destination floor, general information display means 1*m* which is disposed above the destination buttons 1*k* and displays arbitrary information according to an operation which is performed by the user of the elevator, and floor information display means 1*n* which is disposed for each of the destination buttons 1*k* so that the contents of displays become visible from an operation surface of each of the destination buttons 1*k* which the user touches with his or her finger in registering the destination floor and which displays colors, characters, graphics, etc. which show destination floors and floor information etc. of destination floors in a changeable manner. Incidentally, although in FIG. 3, floors such as B1 and 1 and the contents of service afforded on each floor, such as foods and gifts, are displayed as the floor information display means 1*n*, tenants, offices, etc. on each floor may be displayed as required. Information on events for a specific period, time service, etc. may also be displayed to suit the period and time. Incidentally, although the general information display means 1*m* displays information within the building, general information, etc. in a case where a destination button 1*k* is not operated by a user, and displays information on tenants, offices, etc. on a floor selected by an operation of a user in a case where a destination button 1*k* is operated by the user, the general information display means 1*m* is allowed not to display anything when display is unnecessary.

In Embodiment 1 of the present invention, the floor information display means 1*n* which displays floor information etc. of each floor is disposed in quantities of one set for each of the destination buttons 1*k* and the contents of displays of each of the floor information display means 1*n* can be at any time and appropriately changed according to the operation condition of the destination floor registering apparatus 1, information on each floor, etc. Therefore, it is possible to afford better service to users of an elevator. Furthermore, because the floor information display means 1*n* is disposed so that the contents of displays are visible from an operation surface of each of the destination buttons 1*k*, this prevents a user from registering a destination floor different from a destination floor desired by the user. Thus the destination floor registering apparatus 1 is excellent in operability.

Embodiment 2

Figure 4:
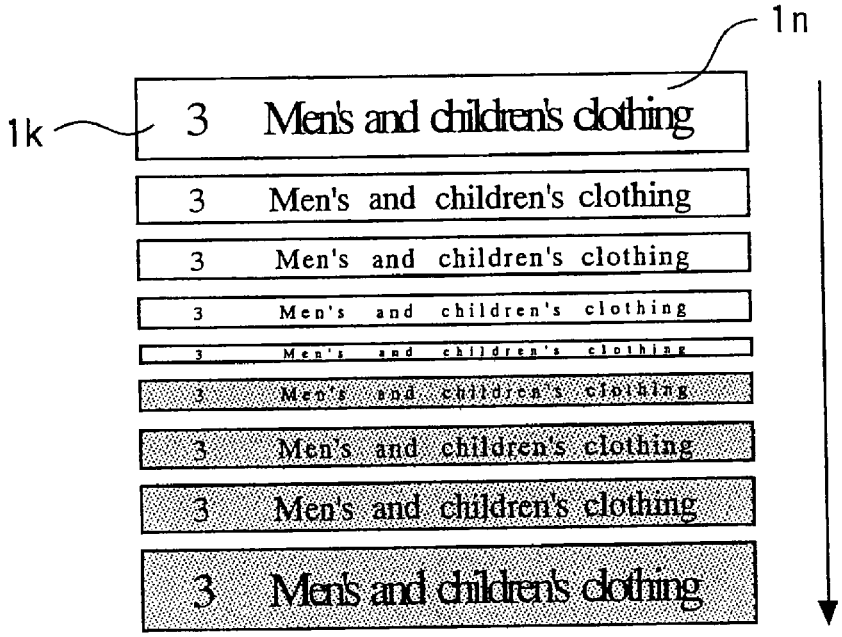
FIG. 4 is a diagram which shows the operation of the destination floor registering apparatus of an elevator in Embodiment 2 of the present invention.

FIG. 4 is a diagram which shows the operation of a destination floor registering apparatus of an elevator in Embodiment 2 of the present invention, and shows the condition of a destination button 1*k* and floor information display means 1*n* in a case where the arbitrary destination button 1*k* has been selected by a user of an elevator. When the user of the elevator has selected the destination button 1*k* for which the floor information display means 1*n* displays gentlemen's and children's clothing on the third floor, the sensor control section 1*e* outputs the operation information such as operation coordinates detected by the sensor 1*d* to the microcomputer 1*h* . On the basis of the inputted operation coordinates, the microcomputer 1*h* judges that the display of the floor information display means 1*n* of the destination button 1*k* registered by the user is gentlemen's and children's clothing on the third floor and makes a judgment whether the present display of the floor information display means 1*n* is updated to a display which shows that the destination floor has been effectively registered. When it is judged that the updating of the contents of the display of the floor information display means 1*n* is necessary, the microcomputer 1*h* takes out display information which shows that gentlemen's and children's clothing on the third floor has been effectively registered from the display information storing section 1*c* and outputs this display information to the display control section 1*b*. On the basis of the inputted display information, the display control section 1*b* updates the contents of the display of the floor information display means 1*n* corresponding to the registered destination floor. FIG. 4 shows how the floor information display means 1*n* displayed on the operation surface of the destination button 1*k* is updated in a time-series manner from up to down. When the destination floor is registered by the user, the destination button 1*k* and the floor information display means 1*n* decrease gradually only in the longitudinal size while keeping the lateral size constant and increase gradually to the original longitudinal size after a prescribed longitudinal size is obtained or the longitudinal size becomes zero. At this time, the background color is changed when the longitudinal size has become a minimum, and the fact that the destination floor has been effectively registered is communicated to the user by the color and movement of the destination button 1*k* and the floor information display means 1*n*.

In Embodiment 2 of the present invention, when a user of the elevator performs the registration operation of a destination floor, the outer shape of a destination button 1*k* corresponding to the registered destination floor and the colors, characters, graphics, etc. of the floor information display means 1*n* displayed on the operation surface of this destination button 1*k* change continuously, whereby the fact that the destination floor has been effectively registered is displayed. Therefore, this user can positively recognize that the destination floor desired by him or her has been effectively registered. Furthermore, because the fact that the destination floor has been effectively registered is displayed by continuously changing the outer shape of the destination button 1*k* and the contents of the display of the floor information display means 1*n*, it is possible to provide accurate information also to users having a color vision disorder. Incidentally, in other respects, Embodiment 2 has the same features and advantages as in Embodiment 1. In Embodiment 2, the description was made of the case where the display section 1*a* can change the outer shape of the destination buttons 1*k* in the same manner as in a touch panel type. However, in a case where the outer shape of the destination buttons 1*k* cannot be changed like a mechanical type, advantages similar to those described above can be obtained by continuously changing the contents of displays of the floor information display means 1*n* which is disposed so as to be visible from the operation surfaces of the destination buttons 1*k*.

Embodiment 3

Figure 5:
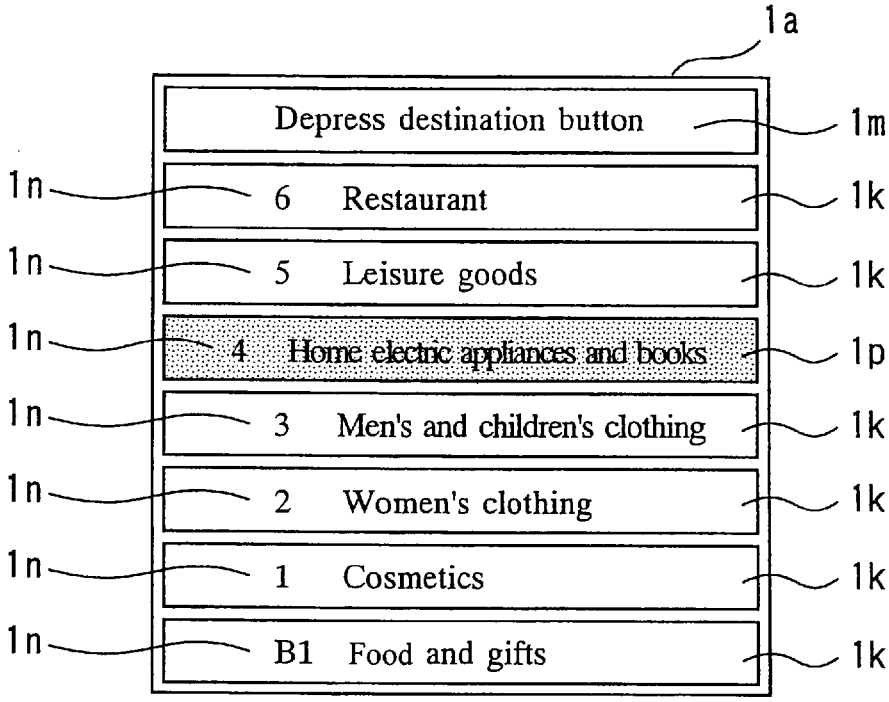
FIG. 5 is a partial detail diagram of the destination floor registering apparatus of an elevator in Embodiment 3 of the present invention.

FIG. 5 is a partial detail diagram of a destination floor registering apparatus of an elevator in Embodiment 3 of the present invention, and shows the construction of the display section 1*a* and the condition when a destination button 1*p* under given conditions has been selected by a user of an elevator. When the operation of the elevator to a certain floor is stopped for reasons of shop remodeling etc., for example, in a case where the operation of the elevator to the selling spaces of home electric appliances and books on the fourth floor is stopped, the destination button 1*p* which displays the floor is displayed in a background color different from the background color of other destination buttons 1*k*. Because the destination floor registering apparatus 1 has this feature, users of the elevator can readily and positively get to know the stop of operation of the elevator to a floor on which an inaccessible tenant etc. are present. Incidentally, in other respects, Embodiment 3 has the same features and advantages as in Embodiment 1.

Embodiment 4

Figure 6:
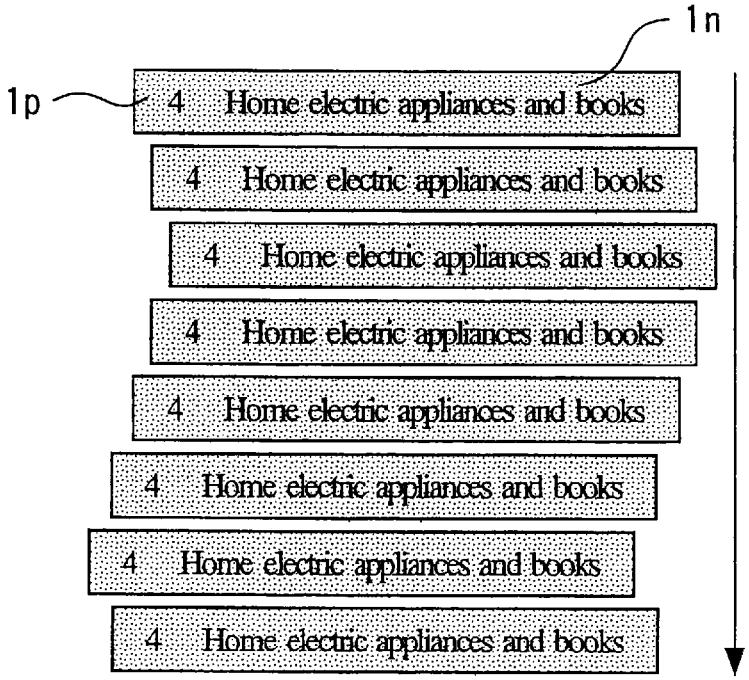
FIG. 6 is a diagram which shows the operation of the destination floor registering apparatus of an elevator in Embodiment 4 of the present invention.

FIG. 6 is a diagram which shows the operation of a destination floor registering apparatus of an elevator in Embodiment 4 of the present invention, and shows the condition of a destination button 1*p* and floor information display means 1*n* in a case where the arbitrary destination button 1*p* under given conditions has been selected by a user of an elevator. When the user of the elevator has selected the destination button 1*p* which shows a floor for which the operation of the elevator is stopped, the sensor control section 1*e* outputs the operation information such as operation coordinates detected by the sensor 1*d* to the microcomputer 1*h*. On the basis of the inputted operation coordinates, the microcomputer 1*h* judges that the display of the floor information display means 1*n* of the destination button 1*p* registered by the user is home electric appliances and books on the fourth floor and makes a judgment the display is displayed in a prescribed background color, and make a judgment whether the present display is updated to a display which further shows that the operation of the elevator has been stopped. When it is judged that the updating of the contents of the display of the floor information display means 1*n* is necessary, the microcomputer 1*h* takes out display information which shows that the operation of the elevator to the fourth floor has been stopped from the display information storing section 1*c* and outputs this display information to the display control section 1*b*. On the basis of the inputted display information, the display control section 1*b* updates the contents of the display of the floor information display means 1*n* corresponding to the registered destination floor. FIG. 6 shows how the floor information display means 1*n* displayed on the operation surface of the destination button 1*p* is updated in a time-series manner from up to down. When the destination floor has been registered by the user, the destination button 1*p* and the floor information display means 1*n* move gradually to one side while keeping their outer shape and background color and then move gradually to the other side when they have reached a prescribed position. The destination button 1*p* and the floor information display means 1*n* repeat this reciprocal movement multiple times, for example, three times and again return to their initial position. In this manner, the fact that the operation of the elevator to a destination floor displayed on the destination button 1*p* by use of which the user intended to register the destination floor has been stopped, is communicated to the user by the movement of the destination button 1*p* and the floor information display means 1*n*. Incidentally, the stop of the operation may be highlighted by further changing background color during the above-described reciprocal movement.

In Embodiment 4 of the present invention, when a user has registered a destination button 1*p* which shows a floor for which the operation of the elevator has been stopped, a continuous change occurs in the outer shape of the destination button 1*p* corresponding to the registered destination floor and the color, characters, graphics, etc. of the floor information display means 1*n* displayed on the operation surface of this destination button 1*p* so as to display information that the operation of the elevator has been stopped, whereby it is possible to provide accurate information also to users having a color vision disorder. Incidentally, in other respects, Embodiment 4 has the same features and advantages as in Embodiment 1.

Embodiment 5

Figure 7:
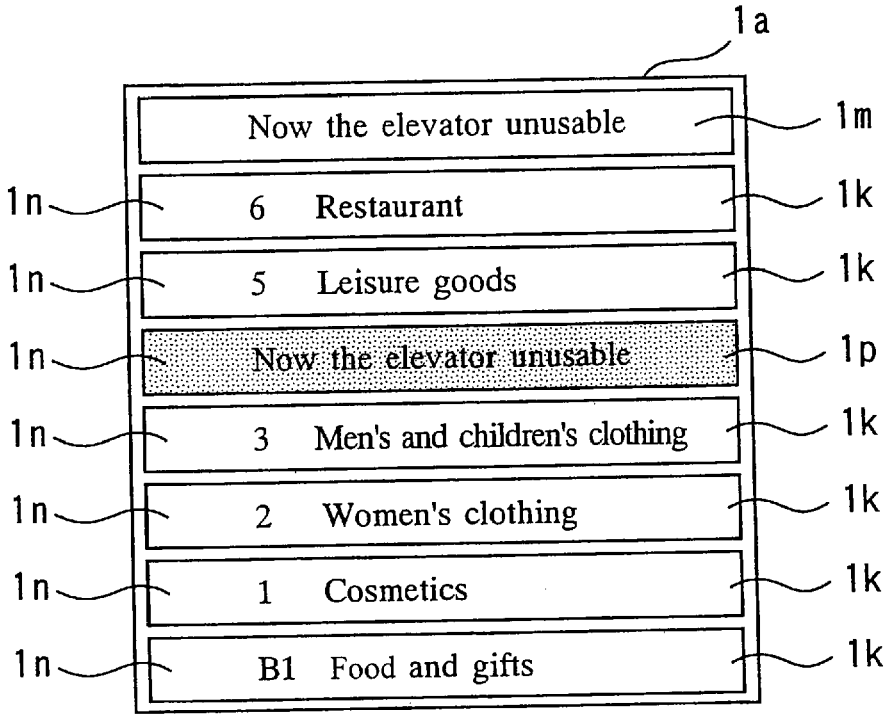
FIG. 7 is a partial detail diagram of the destination floor registering apparatus of an elevator in Embodiment 5 of the present invention.

FIG. 7 is a partial detail diagram of a destination floor registering apparatus of an elevator in Embodiment 5 of the present invention, and shows the condition of the display section 1*a* and the floor information display means 1*n* when a destination button 1*p* of a floor for which the operation of the elevator is stopped has been selected by a user of the elevator. When the destination button 1*p* which shows a floor for which the operation of the elevator is stopped has been selected by an user, the sensor control section 1*e* outputs operation information such as operation coordinates detected by the sensor 1*d* to the microcomputer 1*h*. On the basis of the inputted operation information, the microcomputer 1*h* makes a judgment whether the display of the floor information display means 1*n* of the destination button 1*p* operated by the user is updated to a display which shows that the operation of the elevator has been stopped. The microcomputer 1*h* takes out prescribed display information from the display information storing section 1*c* and performs character display to represent that "now the elevator is unusable," for example, on the operation surface of the destination button 1*p* corresponding to the destination floor registered by the user. Incidentally, although in FIG. 7, the same display is performed also in the general information display means 1*m*, the display in the general information display means 1*m* may be performed as required. The display indicating that the operation of the elevator has been stopped may be performed for a given time considered to be long enough for users to perceive the display, for example, only five seconds after operation information or operation finish information is inputted to the microcomputer 1*h* and then replaced with the original display or this displayed may be continued until another destination button 1*k* is selected by the user. Incidentally, in other respects, Embodiment 5 has the same features and advantages as in Embodiment 4. Embodiment 5 may be constituted in such a manner that as in Embodiment 4, the destination button 1*p* and the floor information display means 1*n* move continuously simultaneously with the above-described character display.

Embodiment 6

Figure 8:
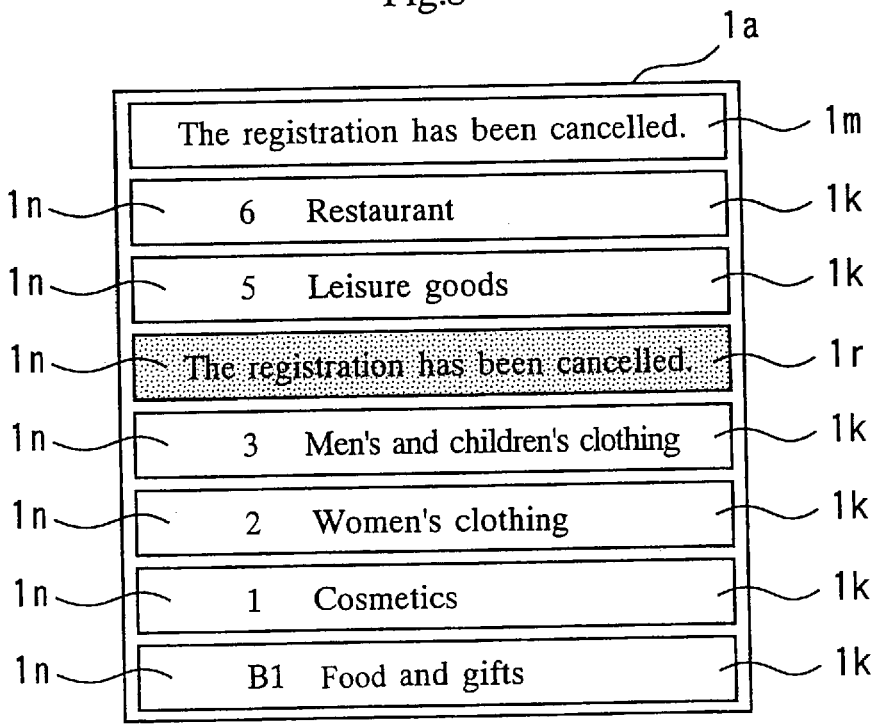
FIG. 8 is a partial detail diagram of the destination floor registering apparatus of an elevator in Embodiment 6 of the present invention.

FIG. 8 is a partial detail diagram of a destination floor registering apparatus of an elevator in Embodiment 6 of the present invention, and shows the condition of the display section 1*a* and the floor information display means 1*n* when after the registration of a destination floor by a user of the elevator, this registration has been cancelled by the operation by this user or by the control by the elevator controller 2. When after the registration of a destination floor by a user, registration cancellation information is inputted to the microcomputer 1*h* by the operation by this user or by the control by the elevator controller 2, on the basis of the inputted registration cancellation information, the microcomputer 1*h* makes a judgment whether the display of the floor information display means 1*n* of the destination button 1*r* in question is updated to a display which shows that the registration has been cancelled. The microcomputer 1*h* takes out prescribed display information from the display information storing section 1*c* and performs character display to represent that "the registration has been cancelled," for example, on the operation surface of the destination button 1*r* corresponding to the destination floor for which the registration has been cancelled. Incidentally, although in FIG. 8, the same display is performed also in the general information display means 1*m*, the display in the general information display means 1*m* may be performed as required. The display indicating that the operation of the elevator has been stopped may be performed for a given time considered to be long enough for users to perceive the display, for example, only five seconds after operation information or operation finish information is inputted to the microcomputer 1*h* and then replaced with the original display or this displayed may be continued until another destination button 1*k* is selected by the user. Incidentally, in other respects, Embodiment 6 has the same features and advantages as in Embodiment 4. Embodiment 6 may be constituted in such a manner that as in Embodiment 4, the destination button 1*r* and the floor information display means 1*n* move continuously simultaneously with the above-described character display.

INDUSTRIAL APPLICABILITY

As described above, in the destination floor registering apparatus of an elevator of the present invention, floor information display means is provided for each destination button and the contents of displays of the floor information display means become visible from an operation surface of each of the destination buttons. Therefore, users of the elevator can at any time and appropriately get to know information on each floor and it is possible to offer better service.

Also, by displaying the contents of displays of the floor information display means by a continuous change in colors, characters or graphics, it is possible to provide positive information also to users having a color vision disorder.

The invention claimed is:

1. A destination floor registering apparatus of an elevator installed in a hall or a car of an elevator and configured to register a desired destination floor of a user, comprising:

multiple destination buttons each configured to register a destination floor; and a floor information display provided for each of the destination buttons and configured to display content from an operation surface of each of the destination buttons, and configured to display registration information on an operation surface of one of the destination buttons corresponding to the desired destination floor of the user to indicate that the desired destination floor of the user is registered, wherein the floor information display displays the registration information by a gradual change in colors, characters, or graphics.

2. The destination floor registering apparatus of an elevator according to claim 1, wherein when the desired destination floor of the user is a floor where stopping of the elevator is prohibited, the floor information display displays prohibition information on the operation surface of the one of the destination buttons to indicate that stopping of the elevator on the desired destination floor is prohibited.

3. The destination floor registering apparatus of an elevator according to claim 2, wherein the floor information display displays the prohibition information by a continuous change in colors, characters, or graphics.

4. The destination floor registering apparatus of an elevator according to claim 1, wherein when a registered destination floor has been cancelled, the floor information display displays cancellation information on the operation surface of the one of the destination buttons to indicate that the registration of the destination floor has been cancelled.

5. The destination floor registering apparatus of an elevator according to claim 4, wherein the floor information display displays the cancellation information by a continuous change in colors, characters, or graphics.

6. The apparatus according to claim 1, wherein the floor information display is further configured to reduce a size of the registration content on the operation surface of the one of the destination buttons to indicate that the desired destination floor of the user is registered.

7. The apparatus according to claim 6, wherein the floor information display is further configured to reduce the size of the registration content in only one dimension to indicate that the desired destination floor of the user is registered, while the size of the registration content in the second dimension remains unchanged.

8. The apparatus according to claim 6, wherein the floor information display is further configured to gradually reduce the size of the registration content over a first time duration and gradually increase the size of the registration content over a second time duration following the first time duration, and to change a color of the registration content after the first time duration.

9. The apparatus according to claim 6, wherein the floor information display is further configured to reduce the size of the displayed content in only a vertical dimension and maintain unchanged the size of the displayed contents in a horizontal dimension to indicate that the desired destination floor of the user is registered.

10. A destination floor registering apparatus of an elevator installed in a hall or a car of an elevator and configured to register a desired destination floor of a user, comprising:

multiple destination buttons each configured to register a destination floor; and a floor information display provided for each of the destination buttons and configured to display content from an operation surface of each of the destination buttons, and configured to change a location of one of the destination buttons corresponding to the desired destination floor of the user to indicate that the elevator will not stop at the destination floor.

11. The apparatus of claim 10, wherein the floor information display is further configured to gradually change a location of the one of the destination buttons to indicate that the elevator will not stop at the destination floor selected by the user.

12. The apparatus of claim 10, wherein the floor information display is further configured to gradually change a location of the one of the destination buttons in a left or right direction and does not change a location of the one of the destination buttons in an up or down direction to indicate that the elevator will not stop at the destination floor selected by the user.

13. A destination floor registering apparatus of an elevator installed in a hall or a car of an elevator and configured to register a desired destination floor of a user, comprising:

multiple destination buttons each configured to register a destination floor; and a floor information display provided for each of the destination buttons and configured to display content from an operation surface of each of the destination buttons, display information on an operation surface of one of the destination buttons corresponding to the desired destination floor of the user, and reduce a size of the displayed content on the operation surface of the one of the destination buttons to indicate that the desired destination floor of the user is registered.

14. The apparatus according to claim 13, wherein the floor information display is further configured to gradually reduce the size of the displayed content over a first time duration and gradually increase the size of the displayed content over a second time duration following the first time duration, and to change a color of the displayed content after the first time duration.

15. The apparatus according to claim 13, wherein the floor information display is further configured to reduce the size of the displayed content in only a vertical dimension and maintain unchanged the size of the displayed contents in a horizontal dimension to indicate that the desired destination floor of the user is registered.

* * * * *